US009033778B2

(12) United States Patent
Jackson

(10) Patent No.: US 9,033,778 B2
(45) **Date of Patent: *May 19, 2015**

(54) BAROMETRIC RELIEF AIR ZONE DAMPER

(71) Applicant: Ronald E Jackson, Indianapolis, IN (US)

(72) Inventor: Ronald E Jackson, Indianapolis, IN (US)

(73) Assignee: Controlled Holdings, LLC, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/218,063

(22) Filed: Mar. 18, 2014

(65) Prior Publication Data

US 2014/0238655 A1 Aug. 28, 2014

Related U.S. Application Data

(63) Continuation of application No. 13/562,859, filed on Jul. 31, 2012, now Pat. No. 8,956,207, which is a continuation-in-part of application No. 13/463,952, filed on May 4, 2012, now abandoned.

(60) Provisional application No. 61/569,845, filed on Dec. 13, 2011.

(51) Int. Cl.

| | |
|---|---|
| ***F24F 11/04*** | (2006.01) |
| ***F24F 11/053*** | (2006.01) |
| ***F24F 13/14*** | (2006.01) |

(52) U.S. Cl.

CPC ..... *F24F 11/04* (2013.01); *F24F 11/053* (2013.01); *F24F 13/1426* (2013.01)

(58) Field of Classification Search

CPC ..... F24F 3/044; F24F 3/0444; F24F 13/02; F24F 13/10; F24F 13/105; F24F 13/12; F24F 13/14; F24F 13/1413; F24F 13/142; F24F 13/1426; F24F 13/1486

USPC ..... 454/255

See application file for complete search history.

(56) References Cited

U.S. PATENT DOCUMENTS

| | | | | | |
|---|---|---|---|---|---|
| 124,931 | A | * | 3/1872 | Boore | 236/45 |
| 366,493 | A | * | 7/1887 | Mann | 236/45 |
| 845,540 | A | * | 2/1907 | Ferguson | 251/164 |
| 1,226,722 | A | * | 5/1917 | Sullivan | 141/268 |
| 1,759,060 | A | * | 5/1930 | Moore | 251/218 |
| 1,852,918 | A | | 4/1932 | Chandler et al. | |

(Continued)

OTHER PUBLICATIONS

U.S. Appl. No. 14/217,967, filed Mar. 18, 2014.

*Primary Examiner* — Gregory Huson
*Assistant Examiner* — Martha Becton
(74) *Attorney, Agent, or Firm* — Brinks Gilson & Lione

(57) ABSTRACT

A control system for an HVAC system serving at least two zones, each zone receiving conditioned air by way of a zone duct, each zone duct including a zone damper having a first portion responsive to the static pressure in a HVAC system to open and bleed an amount of conditioned air past the damper when the static pressure of the system increases above a selected level, a second portion controlled by a actuator to move between an open and a closed position in response to a zone thermostat, and a coupling mechanism coupling the first and second portions to limit the relative movements of the two portions with respect to each other, and a biasing mechanism exerting a torque against the system static pressure differential. The first portion can be a single one-piece undivided blade pivotally mounted with a shell surrounding the zone damper.

7 Claims, 9 Drawing Sheets

(56) References Cited

U.S. PATENT DOCUMENTS

| | | | | | |
|---|---|---|---|---|---|
| 1,973,997 | A | * | 9/1934 | Roberts | 236/45 |
| 1,989,972 | A | * | 2/1935 | Cunningham | 318/675 |
| 2,037,363 | A | | 4/1936 | Branche | |
| 2,164,814 | A | * | 7/1939 | Griffith | 49/87.1 |
| 2,188,775 | A | | 1/1940 | Locke | |
| 2,259,973 | A | | 10/1941 | Firehammer | |
| 2,487,856 | A | * | 11/1949 | Cunningham | 236/45 |
| 2,514,446 | A | | 7/1950 | Field, Jr. | |
| 2,538,190 | A | | 1/1951 | Crew | |
| 2,546,714 | A | | 3/1951 | Bataille | |
| 2,627,799 | A | * | 2/1953 | Kurth et al. | 454/312 |
| 2,654,425 | A | * | 10/1953 | Hayner | 160/62 |
| 2,692,640 | A | * | 10/1954 | Field | 431/20 |
| 2,761,494 | A | | 9/1956 | Field | |
| 2,978,184 | A | * | 4/1961 | Franks | 236/45 |
| 2,981,172 | A | * | 4/1961 | Kalman | 454/352 |
| 3,070,345 | A | | 12/1962 | Knecht | |
| 3,077,345 | A | | 2/1963 | Andersson et al. | |
| 3,206,119 | A | * | 9/1965 | Steinen | 236/45 |
| 3,311,302 | A | | 3/1967 | Merckle | |
| 3,559,684 | A | * | 2/1971 | Rudewick, III | 137/625.17 |
| 3,580,238 | A | * | 5/1971 | Diehl | 126/295 |
| 3,737,142 | A | * | 6/1973 | Boswell et al. | 251/58 |
| 3,818,814 | A | * | 6/1974 | Obler et al. | 454/335 |
| 3,964,514 | A | * | 6/1976 | Manoogian et al. | 137/625.17 |
| 3,993,096 | A | | 11/1976 | Wilson | |
| 4,090,434 | A | | 5/1978 | Krisko et al. | |
| 4,163,415 | A | | 8/1979 | Neveux | |
| 4,285,499 | A | * | 8/1981 | Zukausky | 251/229 |
| 4,294,403 | A | * | 10/1981 | Ammons et al. | 236/13 |
| 4,327,894 | A | * | 5/1982 | Ewing et al. | 251/233 |
| 4,355,753 | A | | 10/1982 | Watanabe | |
| 4,407,447 | A | * | 10/1983 | Sayegh | 236/49.3 |
| 4,487,214 | A | * | 12/1984 | Tatum | 137/72 |
| 4,638,977 | A | * | 1/1987 | Vonhausen | 251/248 |
| 4,694,851 | A | * | 9/1987 | Aalto et al. | 137/499 |
| 4,744,409 | A | * | 5/1988 | Berner | 165/4 |
| 4,773,362 | A | | 9/1988 | Wissmann et al. | |
| 5,048,792 | A | * | 9/1991 | Fischer | 251/297 |
| 5,088,388 | A | * | 2/1992 | Schaefer | 454/271 |
| 5,139,230 | A | | 8/1992 | Lester | |
| 5,249,596 | A | | 10/1993 | Hickenlooper, III et al. | |
| 5,326,075 | A | * | 7/1994 | Goff | 251/285 |
| 5,345,966 | A | * | 9/1994 | Dudley | 137/601.08 |
| 5,584,312 | A | * | 12/1996 | Van Becelaere | 137/78.5 |
| 5,603,869 | A | * | 2/1997 | McNew et al. | 261/71 |
| 5,669,815 | A | | 9/1997 | Cakebread | |
| 5,674,125 | A | | 10/1997 | Xia et al. | |
| 5,735,456 | A | * | 4/1998 | Marin et al. | 236/75 |
| 5,881,994 | A | * | 3/1999 | Stevenson et al. | 251/250.5 |
| 5,944,445 | A | | 8/1999 | Montgomery | |
| 6,089,464 | A | | 7/2000 | Morgan | |
| 6,234,208 | B1 | | 5/2001 | Magdelyns et al. | |
| 6,364,211 | B1 | | 4/2002 | Saleh | |
| 6,640,390 | B1 | * | 11/2003 | Lai | 16/441 |
| 6,685,557 | B1 | * | 2/2004 | Hoffe | 454/259 |
| 6,722,631 | B2 | * | 4/2004 | Bailey | 251/251 |
| 6,789,617 | B1 | * | 9/2004 | Hashizume et al. | 165/202 |
| 7,156,370 | B2 | * | 1/2007 | Albizuri | 251/207 |
| 7,478,628 | B2 | | 1/2009 | Hines | |
| 7,566,264 | B2 | * | 7/2009 | Votaw et al. | 454/333 |
| D634,419 | S | | 3/2011 | Lambertson | |
| 8,281,780 | B2 | * | 10/2012 | Carvalho et al. | 126/39 E |
| 8,956,207 | B2 | * | 2/2015 | Jackson | 454/255 |
| 2001/0027814 | A1 | * | 10/2001 | Stone et al. | 137/601.12 |
| 2004/0026175 | A1 | * | 2/2004 | Oh et al. | 185/40 B |
| 2006/0144582 | A1 | * | 7/2006 | Sekiya et al. | 165/202 |
| 2007/0093196 | A1 | * | 4/2007 | Morse et al. | 454/290 |
| 2007/0173192 | A1 | * | 7/2007 | Votaw et al. | 454/256 |
| 2008/0116288 | A1 | * | 5/2008 | Takach et al. | 236/49.5 |
| 2008/0233861 | A1 | * | 9/2008 | Jenkins et al. | 454/241 |
| 2009/0076658 | A1 | * | 3/2009 | Kinnis | 700/277 |
| 2009/0186572 | A1 | * | 7/2009 | Farrell | 454/256 |
| 2011/0247694 | A1 | * | 10/2011 | Sheldon et al. | 137/1 |
| 2013/0049644 | A1 | * | 2/2013 | Neumann | 318/15 |
| 2013/0333502 | A1 | * | 12/2013 | Barton et al. | 74/405 |
| 2013/0333784 | A1 | * | 12/2013 | Marak et al. | 137/601.17 |
| 2013/0334325 | A1 | * | 12/2013 | Marak et al. | 236/49.3 |
| 2013/0337736 | A1 | * | 12/2013 | Marak et al. | 454/317 |

* cited by examiner

BAROMETRIC RELIEF AIR ZONE DAMPER

CROSS-REFERENCE TO RELATED APPLICATION

This application is a continuation of U.S. Ser. No. 13/562,859, filed Jul. 31, 2012, which is a continuation-in-part of U.S. Ser. No. 13/463,952 filed May 4, 2012, which in turn is related to and claims all benefit of U.S. Provisional Application Ser. No. 61/569,845 filed Dec. 13, 2011.

BACKGROUND

This invention relates to heating, ventilating and air conditioning ("HVAC") systems that include at least two zones controlled by sensors, generally thermostats, located within the at least two zones that control corresponding dampers in ducts leading from usually a single HVAC source to the at least two zones.

In a conventional HAVC zoning system, conditioned air can be supplied to a plurality of zones, each zone being controlled by its own thermostat. Zoning systems for such an HVAC system typically includes zone dampers disposed in the ductwork for controlling the air flow of the conditioned air to the zones in response to the thermostat. These zoning systems control the flow of conditioned air to the plurality of zones independently so as to allow for independent control of the zone environments. As a result, at any given time a number of zone dampers may be open or closed. As the temperature in each zone is satisfied, its zone damper will close causing the static pressure in the duct system to rise. This rise in static duct pressure can result in an increase in noise and drafts due, in part, to an increase in air flow velocity though the ducts in zones still calling for conditioned air.

Conventionally, a bypass damper system is used to relieve excess static duct pressure. For example, a bypass damper can be connected between the supply and return air duct. If the bypass damper system determines that the air flow to a supply air duct is causing excess static duct pressure, then the bypass damper will be modulated open to recycle the conditioned air from the supply air duct to the return air duct. This implementation has the disadvantage of being energy inefficient, and hence an expensive way to solve the problem. Bypass dampers can also be expensive to install and difficult to setup. Elimination of the aforementioned bypass damper system could reduce the amount of HVAC system equipment, which, in turn, would reduce installation and maintenance costs.

What is needed is alternative apparatus that can effectively and efficiently control excess static duct pressure without resorting to the use of a bypass damper.

SUMMARY

The alternative apparatus can take the form of each zone damper being replaced with a zone damper that, in addition to being controlled by the corresponding zone thermostat, also includes a mechanical portion responsive to the barometric pressure differential in the system to open and bleed a small amount of conditioned air into each zone when the static pressure of the system increases above a selected level.

In a preferred embodiment, the zone damper can include two portions that are hinged to each other to permit independent movement of the two portions relative to each other. A first of the portions can be connected to a damper actuator controlled by a corresponding zone thermostat to open and close in response to the need for conditioned air within the zone. A second of the portions can also be moved by the damper actuator from the closed position to an open position to ensure maximum air flow through the duct in response to the need for conditioned air within the zone. As the first portion moves from the open position to the closed position, the second portion can also move toward the closed position, but may not entirely close if the static pressure differential in the system is too high.

In a preferred embodiment, the second portion of the zone damper can include a counter balance weight, which may be adjustable, to set the desired static pressure differential value that will be allowed. If the system static pressure differential rises above the set desired pressure differential value, the second portion responds by opening sufficiently to reduce the system static pressure differential to the desired value. The counter balance weight and adjustment mechanisms can be of a variety of constructions. A removable access panel can be provided in the zone ducting adjacent to the zone damper to permit access to and adjustment of the counter balance weight to the desired level. Additionally, a lock or stop can be provided to fix the position of the second portion relative to the first portion or to set the maximum deflection of the second portion relative to the first portion in certain situations.

In a further preferred embodiment, the zone damper can include a coupling mechanism between the damper blade and the damper actuator that includes a provision for limited relative movement so that the damper blade can respond to the barometric pressure differential in the system to open and bleed an appropriate amount of conditioned air into each zone when the static pressure of the system increases above a selected level. The coupling mechanism can include a shaft coupled to one of the damper blade and damper actuator and a cylinder surrounding the shaft coupled to another of the damper blade and damper actuator, one of the shaft and cylinder including slot and the other of the shaft and cylinder including a projection into the slot defining limits to the relative movement between the shaft and cylinder. The shaft and cylinder need not be of the same length.

A feature of the disclosed zone dampers is the inclusion of barometrically responsive portions that effectively eliminate the need for any bypass damper system and hence reduce the size of damper inventory. An advantage of the disclosed zone dampers is a reduction in drafts and air noise, and a reduction in coil freeze up, with a resulting increase in system energy efficiency.

Other features and advantages of the present barometric zone damper and the corresponding advantages of those features will become apparent from the following discussion of preferred embodiments, which is illustrated in the accompanying drawings. The components in the figures are not necessarily to scale, emphasis instead being placed upon illustrating the principles of operation. Moreover, in the figures to the extent possible, like referenced numerals designate corresponding parts throughout the different views.

DESCRIPTION OF PREFERRED EMBODIMENTS

Figure 1:
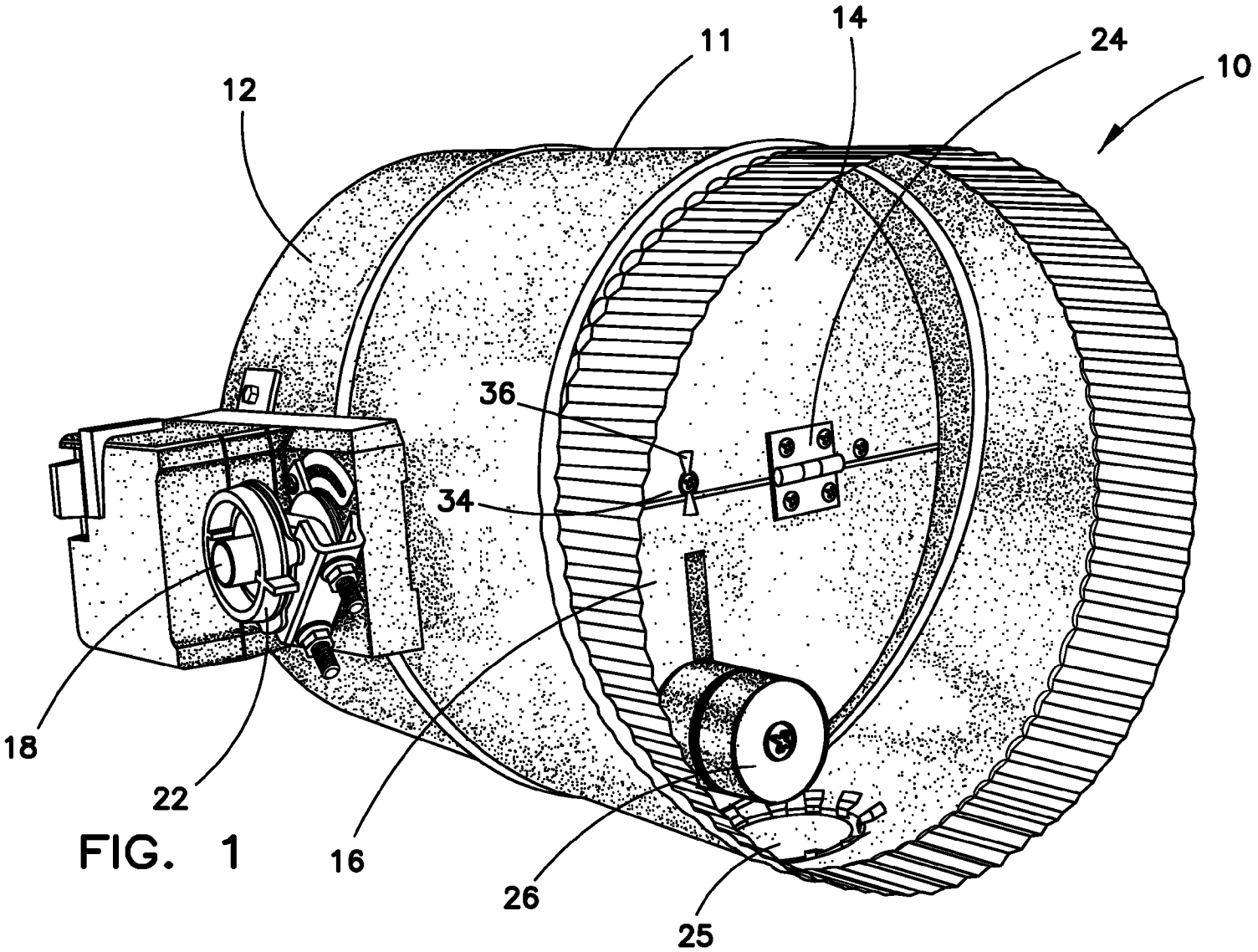
FIG. 1 is a perspective view of a barometrically responsive zone damper positioned within a shell.

FIG. 1 shows a barometrically responsive zone damper 10 positioned within a segment of ducting 11, which forms a damper shell 12. The damper 10 can include an upper portion 14 and a lower portion 16. The upper portion 14 can be fixed to a shaft 18 mounted in bushings fixed in the shell 12, the shaft 18 extending through the shell 12. The position of the shaft 18 and upper portion 14 of the zone damper 10 can be controlled by a damper actuator 22 that can be located on the outside or inside of the shell 12. The damper actuator 22 can be situated on either side of the shell 12 and controlled by a zone thermostat, not shown. The lower portion 16 of the zone damper 10 is connected to the upper portion 14 of the damper by a hinge 24 to permit independent movement of the lower portion 16 relative to the upper portion 14. In the absence of a sufficient air pressure differential or air flow through the ducting 11, the force of gravity will cause the lower portion 16 to pivot to a position in alignment with the upper portion 14 as shown. The force acting to close the lower portion 16 can be increased by attaching a weight 26 of selected size to the lower portion 16.

Figure 3:
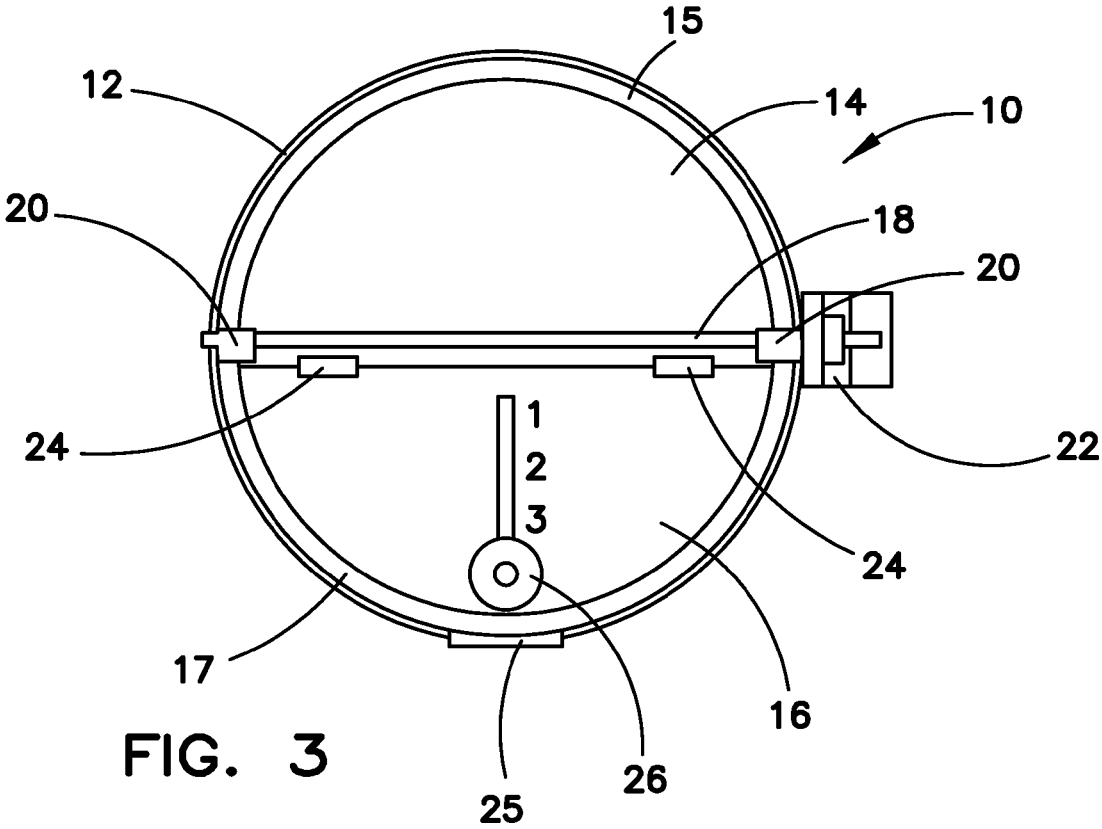
FIG. 3 is a schematic front elevation view of a barometrically responsive zone damper positioned within a shell.

The amount of the force acting to close the lower portion 16 can be modified by modifying the size of the weight 26 or by adjusting the position the weight 26 so as to increase or decrease the torque applied to the lower portion 16 as shown in FIG. 1 and FIG. 3. A removable access panel 25 can be provided in the shell 12 adjacent to the zone damper 10 to permit access to and adjustment of the counter balance weight 26 to the desired level. FIG. 3 also shows the upper portion 14 fixed to the shaft 18, which can be mounted in bushings 20, which can be formed of nylon or similar durable material, fixed in the shell 12, the shaft 18 extending through the shell 12. Both portions 14 and 16 are shown to have a gasket 15, 17 adjacent to the shell 12 to provide a suitable seal to prevent unwanted leaking past the zone damper 10. A lock 34 can also be provided to fix the position of the lower portion 16 in relation to the upper portion 14. The lock 34 can take the form of a butterfly blade lock 36. When barometric pressure differential relief is desired, the butterfly blade lock 36 can be rotated from the locked position shown in FIG. 1 to a horizontal un-locked position as shown in FIG. 4.

Figure 2:
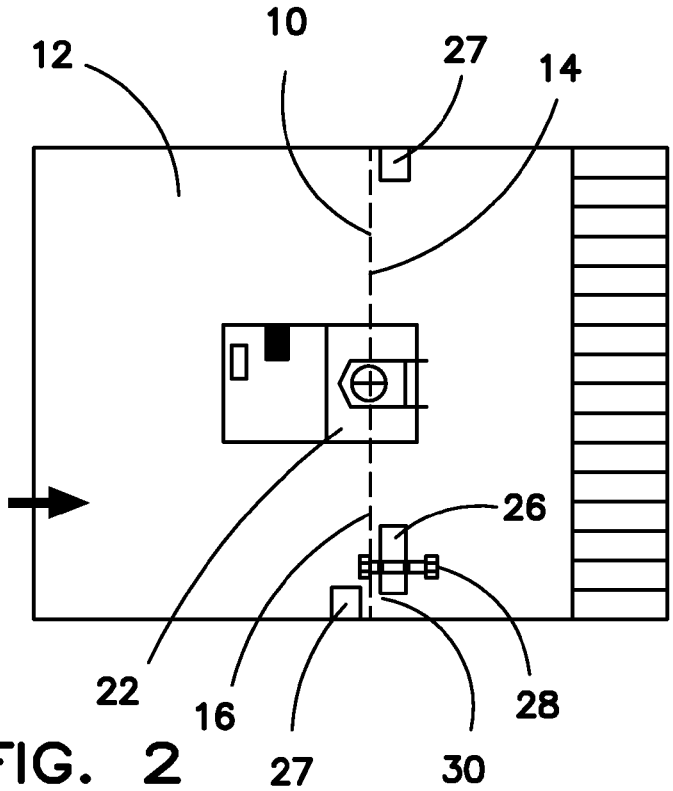
FIG. 2 is a schematic side elevation view of a barometrically responsive zone damper positioned within a shell.

A variations of the barometric zone damper is shown in FIG. 2, which is a schematic side elevation view of a barometrically responsive zone damper 10 positioned within a shell 12. The damper 10 is shown to include an upper portion 14 and a lower portion 16. The position of the upper portion 14 of the zone damper 10 can be controlled by a damper actuator 22 that can be located on the outside of the shell 12. The damper actuator 22 can be controlled by a zone thermostat, not shown. The lower portion 16 of the zone damper 10 is connected to the upper portion 14 in a manner to permit independent movement of the lower portion 16 relative to the upper portion 14. In the absence of a sufficient air pressure differential on opposite sides of the zone damper 10, or any air flow through the ducting 11, the force of gravity will cause the lower portion 16 to pivot into alignment with the upper portion 14. Gaskets 27 can be included in the shell 12 to seal against damper portions 14 and 16 when the portions are in a closed position. One or more weights 26 can be added to or subtracted from a screw 28 located adjacent to a lower margin 30 of the lower portion 16 to increase or decrease the force acting to close the lower portion 16.

Figure 4:
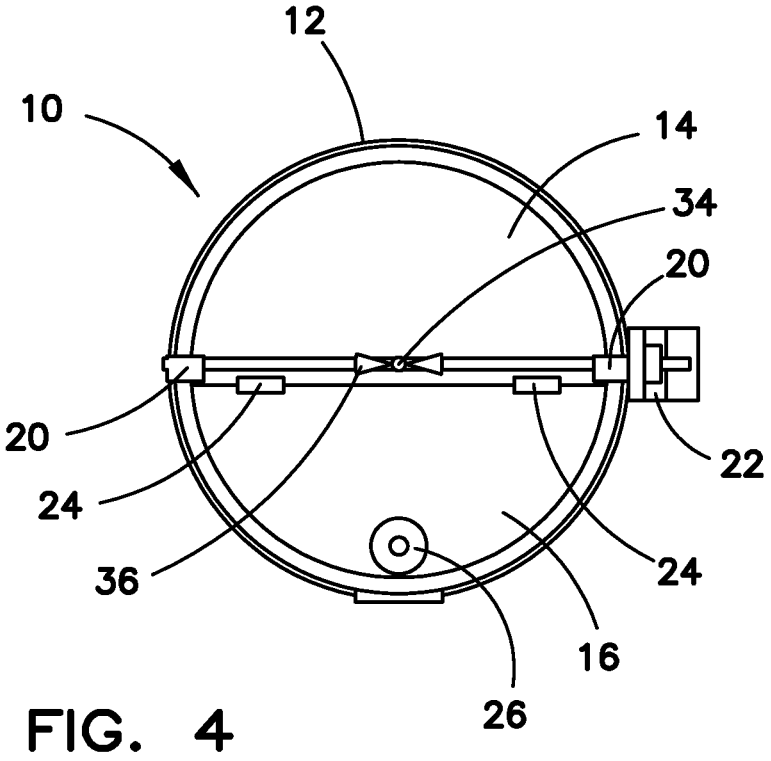
FIG. 4 is a schematic front elevation view of another barometrically responsive zone damper positioned within a shell.

FIG. 4 shows a schematic front elevation view of another barometrically responsive zone damper 10 positioned within a shell 12. The damper 10 is shown to include an upper portion 14 and a lower portion 16. The position of the upper portion 14 of the zone damper 10 can be controlled by a damper actuator 22 located on the outside of the shell 12. The lower portion 16 is connected to the upper portion 14 in a manner to permit independent movement of the lower portion 16 relative to the upper portion 14. In the absence of a sufficient air pressure differential on opposite sides of the zone damper 10, or any air flow through the shell 12, the force of gravity will cause the lower portion 16 to pivot into alignment with the upper portion 14. A lock 34 can also be provided to fix the position of the lower portion 16 in relation to the upper portion 14. The lock 34 can take the form of a butterfly blade lock 36. If, in a particular installation, no barometric pressure differential relief is deemed necessary, the butterfly blade lock 36 can be rotated from the un-locked position shown in FIG. 4 to a vertical locked position, in which case the damper 10 would perform as a conventional zone control damper.

Figure 5:
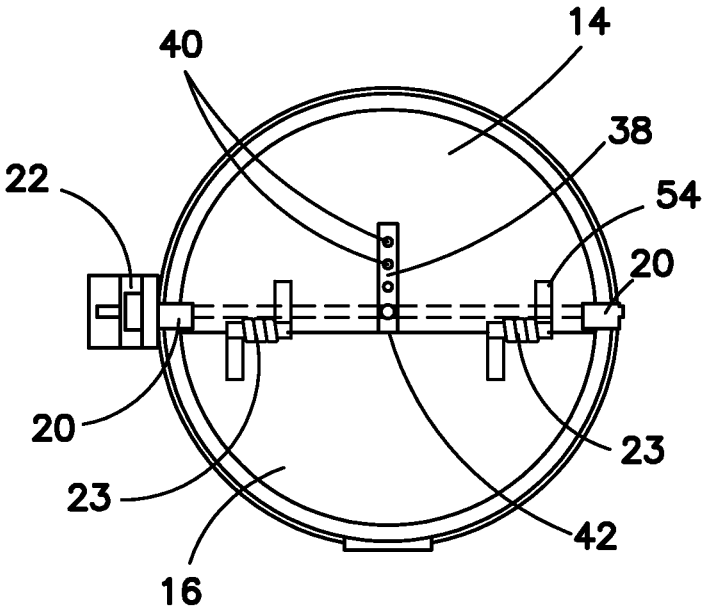
FIG. 5 is a schematic front elevation view of yet another barometrically responsive zone damper positioned within a shell.

FIG. 5 is a schematic front elevation view of yet another barometrically responsive zone damper 10 positioned within a shell 12. The damper 10 is shown to include an upper portion 14 and a lower portion 16. The position of the upper portion 14 of the zone damper 10 can be controlled by a damper actuator 22 located on the outside of the shell 12. It is to be noted that in this embodiment, no counter balance weight is coupled to portion 16. Instead, the portion 16 is connected to the portion 14 by spring biased hinges 23, each incorporating a helical torsion spring 54, the hinges permitting independent movement of the portion 16 relative to the portion 14 and the springs 54 providing a desired biasing force. In the absence of a sufficient air pressure differential on opposite sides of the zone damper 10, or any air flow through the shell 12, the force provided by the spring biased hinges 23 will cause the lower portion 16 to pivot into alignment with the upper portion 14. The amount of force can be determined by specifying the strength of the spring element 54 included in the spring biased hinges 23, or by specifying the number of spring biased hinges coupling the upper portion 14 to the lower portion 16. While the spring element 54 providing the biasing force has been illustrated as being incorporated into a spring biased hinge 23, the spring can take other forms including, for example, a leaf or bow spring, or a volute spring, coupled to both the upper portion 14 and the lower portion 16. The shaft 18 can be located at any angle relative to HVAC system as a whole, since the position of portion 16 in relation to portion 14 is not governed entirely by gravity, but rather by the force supplied by the one or more springs. This allows for the barometrically responsive zone damper 10 to be located in a duct 12 that may be vertically oriented or at least inclined so that the force opposing any pressure differential is only partly dependent on gravity.

A lock 34 can also be provided to fix the position of the lower portion 16 in relation to the upper portion 14. The lock 34 in FIG. 5 takes the form of a strap 38, which can include a series of holes 40 or a slot permitting the strap to be adjusted from an unlocked position as shown in FIG. 5 to a position where a lower end 42 of the strap 38 overlaps at least a portion of lower portion 16 to maintain the upper portion 14 and lower portion 16 in alignment with each other. When the strap 38 is in the locked position, the damper 10 would perform as a conventional zone control damper.

Figure 6:
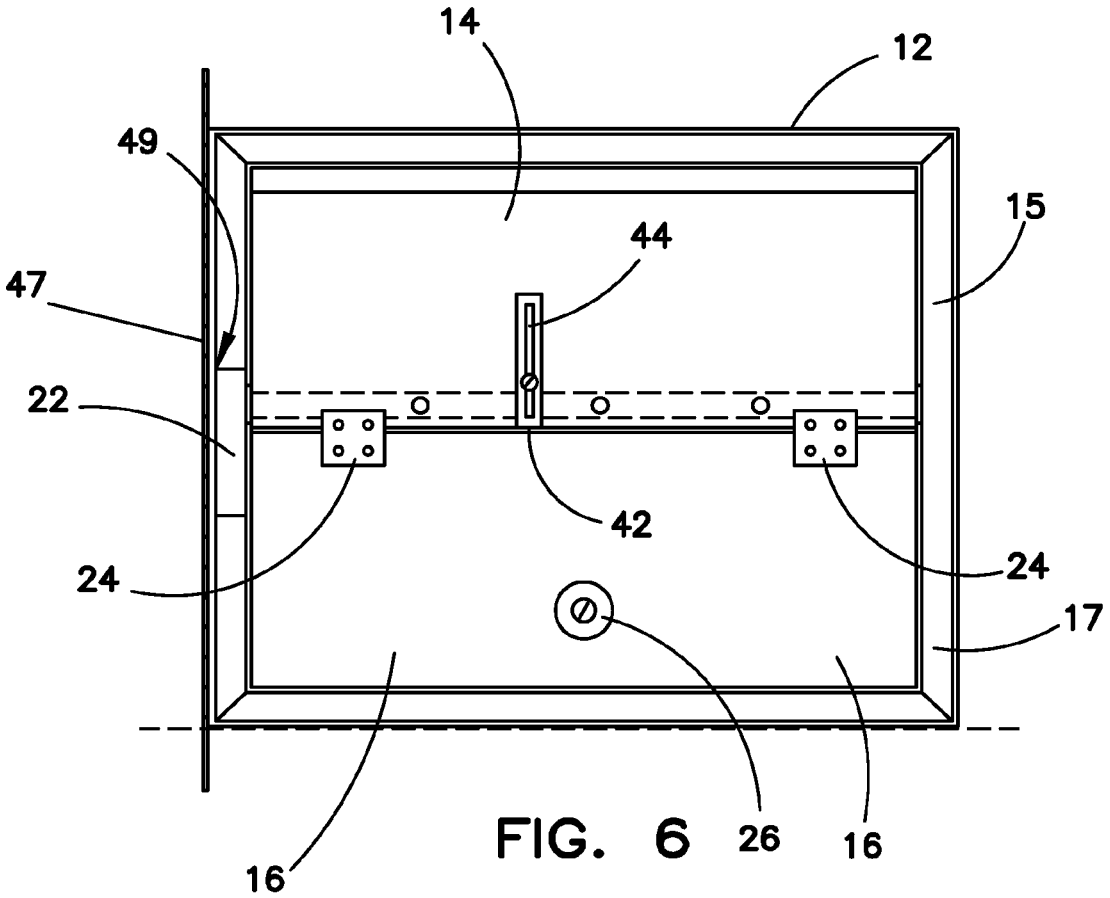
FIG. 6 is a schematic front elevation view of still another barometrically responsive zone damper positioned within a shell.

FIG. 6 is a schematic front elevation view of still another barometrically responsive zone damper 10 positioned within a shell 12, which is shown to be rectangular. The shape of the perimeter of the zone damper 10 can be formed in any shape necessary for a given installation. Again, damper 10 is shown to include an upper portion 14 and a lower portion 16. The position of the upper portion 14 of the zone damper 10 can be controlled by a damper actuator. FIG. 6 shows a damper actuator 22 that has a sufficiently low profile to lie in the region of a damper frame 47 surrounding the shell 12, and between the shell 12 and a damper mounting plate 49 supporting the damper 10 in the related HVAC system. As in the other embodiments, the lower portion 16 is connected to the upper portion 14 by hinges 24 to permit independent movement of the lower portion 16 relative to the upper portion 14. In the absence of a sufficient air pressure differential on opposite sides of the zone damper 10, or any air flow through the shell 12, the force of gravity will cause the lower portion 16 to pivot into alignment with the upper portion 14. A lock 34 can also be provided to fix the position of the lower portion 16 in relation to the upper portion 14. The lock 34 in FIG. 5 takes the form of a strap 38, which includes a slot 44 permitting the strap to be adjusted from an unlocked position as shown in FIG. 6 to a position where a lower end 42 of the strap 38 overlaps at least a portion of lower portion 16 to maintain the upper portion 14 and lower portion 16 in alignment with each other. When the strap 38 is in the locked position, the damper 10 would perform as a conventional zone control damper.

Figure 7:
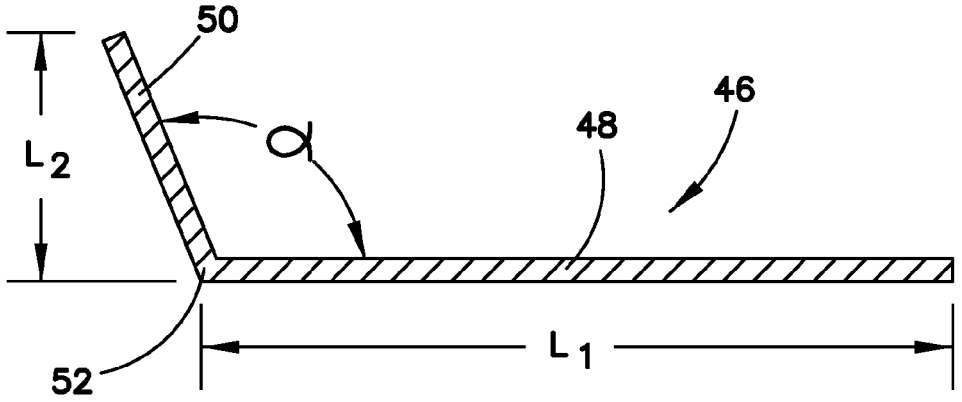
FIG. 7 is a side elevation view of a lock down clip that can be used on a barometrically responsive zone damper to control the relative displacement of the first and second portions of the damper with respect to each other.

The strap 38 can also take the form shown in FIG. 7 is a side elevation view of a clip 46 that includes a first portion 48 that can be coupled to a surface of the upper damper portion 14. The clip 46 can also include a second portion 50 that can be inclined at an angle $\alpha$ with respect to portion 48. The clip first portion 48 can be positioned on the upper damper portion 14 so that the junction 52 of the portions 48 and 50 overlies the junction of the upper damper portion 14 and the lower damper portion 16. The angle $\alpha$ of the clip 46 sets a maximum deflection that the second portion 16 of the damper 10 can achieve relative to the first portion 14. While FIG. 7 shows the portions 48 and 50 of clip 46 to be inclined at an angle of about 110° relative to each other, the angle can range between about 90° and 140°. While FIG. 7 shows the length $L_1$ of portion 48 to be greater than the length $L_2$ of portion 50, the portions 48 and 50 may be of equal length.

Figure 8:
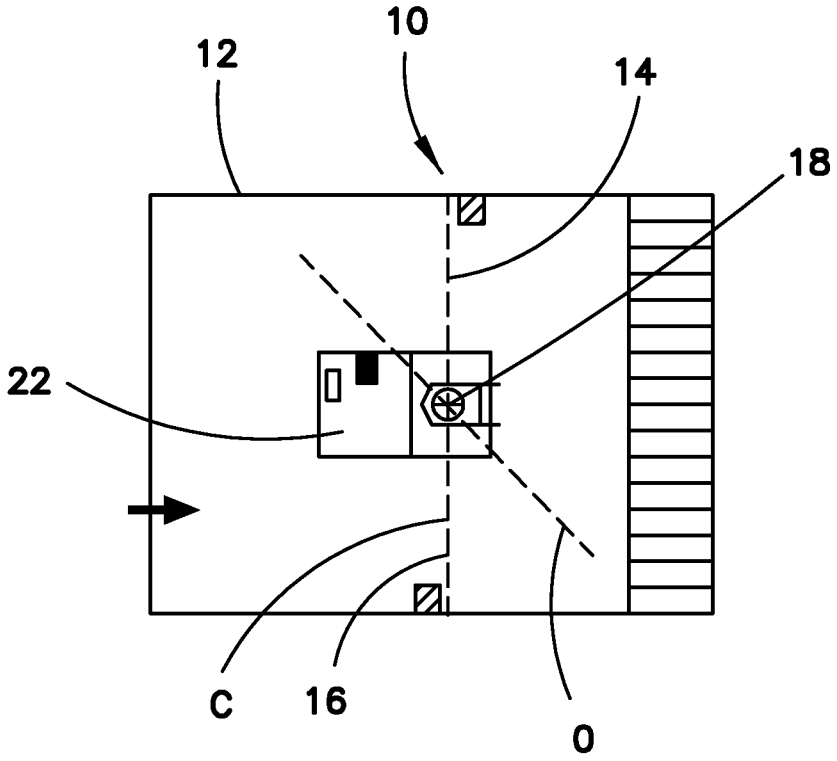
FIG. 8 is a schematic sectional view of a barometrically responsive zone damper moved to a partially open position by a damper actuator.
Figure 9:
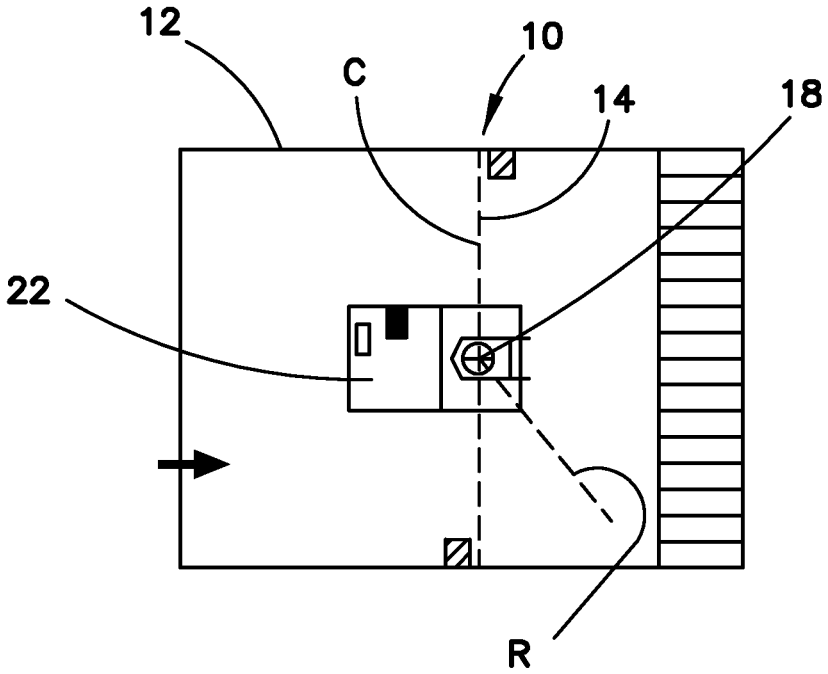
FIG. 9 is a schematic sectional view of a barometrically responsive zone damper in a closed position with a lower portion being moved to a partially open position by virtue of a pressure differential across the damper resulting in an air flow through the duct.

An appreciation of the operation of the barometrically responsive zone dampers 10 can be gained from a consideration of FIGS. 8 and 9 in which the damper 10 includes a first portion 14 and a second portion 16. The first portion 14 is fixed to shaft 18 so that any rotation of shaft 18 will cause a corresponding angular displacement of the portion 14. The position of the shaft 18 and first portion 14 of the zone damper 10 can be controlled by a damper actuator 22 that can be, in turn, controlled by a zone thermostat, not shown. The second portion 16 is connected by one or more hinges to the first portion 14 to permit independent movement of the second portion 16 relative to the first portion 14. A biasing force supplied by one or more weights, springs, or other biasing means, or a locking element can be suitably positioned, to maintain the second portion 16 in alignment with the first portion 14 as shown in FIG. 8. As the shaft 18 rotates from a closed position C, in which the damper 10 blocks air flow through the duct 12, to a partially open position O, in which air can flow through the duct 12 past the damper 10, both portions 14 and 16 move with the rotation of the shaft 18 in the manner of a conventional zone control damper.

In the absence of a locking element, or with the locking element situated in an un-locked position allowing relative movement between second portion 16 and first portion 14, the rotation of shaft 18 will still cause a corresponding angular displacement of the portion 14. Portion 16, however, is free to respond to a pressure differential across the damper 10, which if sufficient to overcome the biasing force, will allow portion 16 to open to a relief position R even though portion 14 remains in the closed position C as shown in FIG. 9 to bleed a sufficient amount of air through the duct 12 to keep the static pressure differential from rising to an unacceptable level.

With each of the illustrated variations, if the system static pressure differential rises above the set desired pressure value, the lower or second portion 16 of the zone damper 10 can respond by opening sufficiently to reduce the system static pressure to a desired value. In a preferred system, the biasing force supplied by the one or more springs, or by the weights 26, can be such that the second or lower portion 16 of the damper 10 will begin to open independent of the first portion 14 at approximately 0.3" WC of static pressure. The use of any of the illustrated variations of barometric zone dampers effectively eliminates the need for any bypass damper system.

Figure 10:
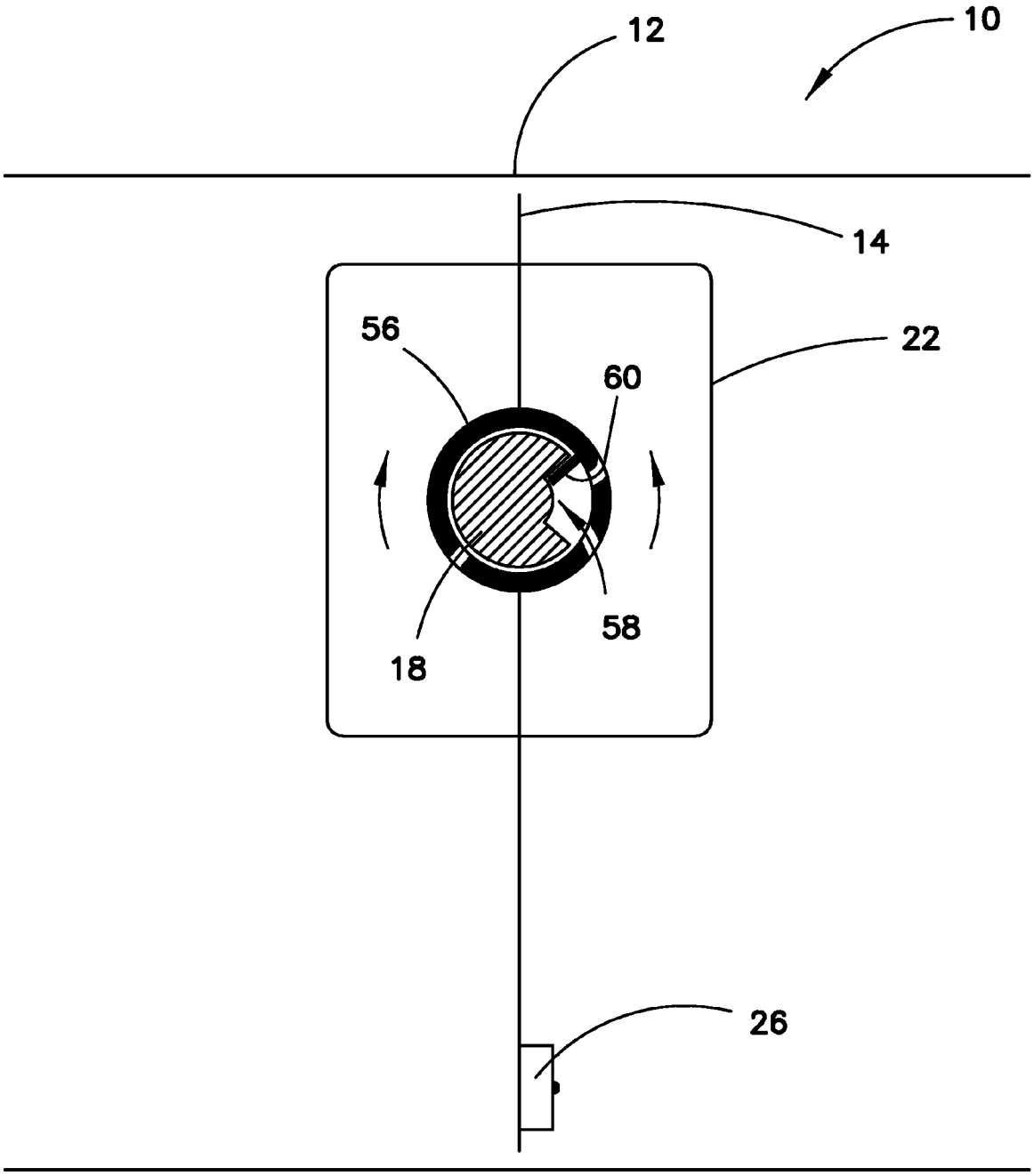
FIG. 10 is a schematic sectional view of a barometrically responsive zone damper that includes a coupling mechanism between the damper blade and the damper actuator providing limited relative movement between the damper blade and damper actuator.
Figure 11:
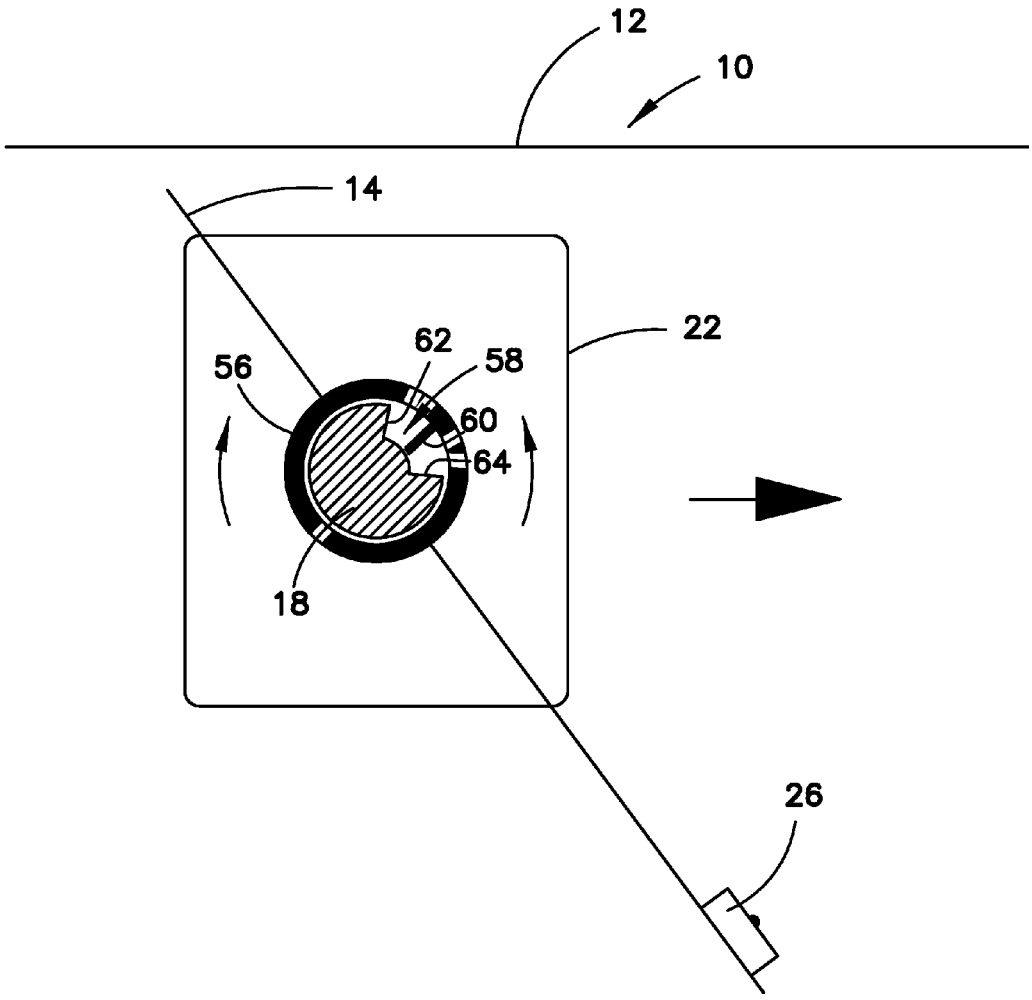
FIG. 11 is a schematic sectional view of the barometrically responsive zone damper of FIG. 10 moved to a partially open position by a static pressure differential across the damper resulting in an air flow.
Figure 12:
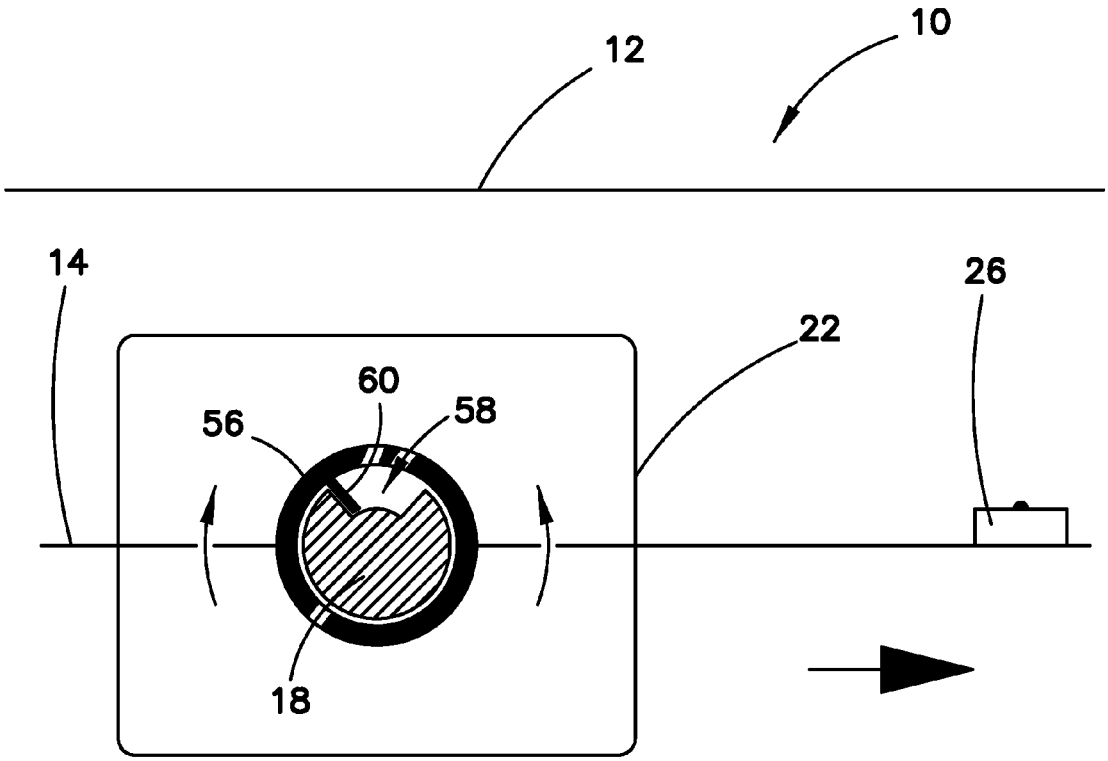
FIG. 12 is a schematic sectional view of the barometrically responsive zone damper of FIG. 10 moved to a fully open position by the damper actuator.

FIGS. 10-12 show the operation of a zone damper 10 of a slightly different design that includes a shell 12 containing a damper blade 14 coupled to a shaft 18. The damper blade 14 can be in the form of a one piece, un-divided blade. A cylinder 56 can surround at least a portion of the shaft 18, the cylinder 56 being controlled by an actuator 22. The shaft 18 is shown to include a slot 58, while the cylinder 56 is shown to include a projection 60 that projects into the slot 58. The cylinder 56 is movable by the actuator 22 between a closed position shown in FIG. 10, and an open position shown in FIG. 12 in response to a suitable thermostat, not shown. The damper blade 14 and shaft 18 are movable relative to the cylinder 56 in response to the static pressure differential in an HVAC system as shown, for example in FIG. 11, to bleed an amount of conditioned air past the damper blade 14 when the static pressure differential of the system increases above a selected level. The end 62 and end 64 of slot 58, shown in FIG. 11, define the limits of travel of the projection 60 within the slot 58 and the corresponding limits of travel of the shaft 18 within the cylinder 56. As in the prior embodiments, the force acting to close the damper blade 14 can be increased by attaching a weight 26 of selected size to a suitable location on the damper blade. The amount of the force acting to close the damper blade 14 can be modified by modifying the size of the weight 26 or by adjusting the position the weight 26 so as to increase or decrease the torque applied to the damper blade.

It will be appreciated by those skilled in the art that the shaft 18 could be coupled to the actuator 22, while the cylinder 56 could be coupled to the damper blade 14. It will also be appreciated by those skilled in the art that the slot 58 could be located on the interior surface of the cylinder 56, while the projection 60 could project outward from the shaft 18 into the slot. The shaft 18 and cylinder 56 need not be of the same length. While the slot 58 is shown to provide for about 90° of relative movement between the shaft and cylinder, the scope of relative movement is subject to some choice of design and may be limited or enlarged to provide less or more relative movement. It will also be appreciated by those skilled in the art that a suitable spring could be substituted for the weight 26 to provide the desired biasing force, the spring being coupled, for example, between the shaft 18 and the cylinder 56.

Figure 13:
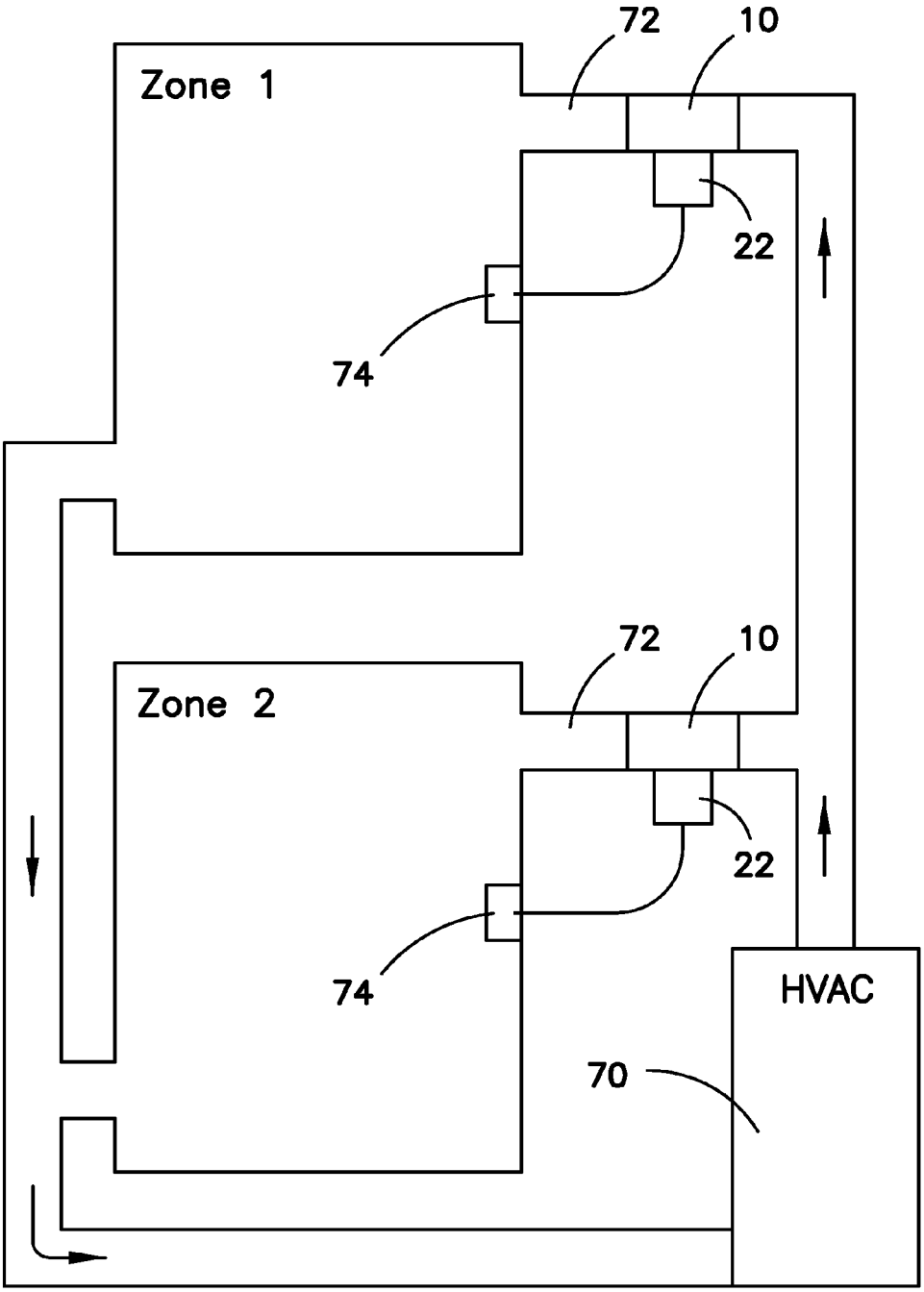
FIG. 13 is a schematic view of an installation using an HVAC control system including barometrically responsive zone dampers.

An HVAC system serving two zones is shown in FIG. 13. Each zone receives conditioned air from a single HVAC unit 70 by way of a zone duct 72 leading from the HVAC system to the zone. Each zone duct 72 includes a zone damper 10. Each zone damper 10 is controlled by an actuator 22 as previously described. Each damper actuator 22 is controlled by a corresponding zone thermostat 74 located in each zone. While only two zones are shown in the drawing, any number of zones can be served in the same manner.

While these features have been disclosed in connection with the illustrated preferred embodiments, other embodiments of the invention will be apparent to those skilled in the art that come within the spirit of the invention as defined in the following claims.

The invention claimed is:

1. A control system for an HVAC system serving at least two zones, each zone receiving conditioned air by way of a zone duct leading from the HVAC system to the zone, the control system comprising:

a zone thermostat located in each zone, a zone damper located in each of the at least two zones and configured to control the flow of conditioned air through each of the at least two zones in which the corresponding zone damper is located, each zone damper including a shell, a single one-piece damper blade pivotally mounted within the shell, an actuator coupled to each shell and responsive to the corresponding zone thermostat, to cause movement of the damper blade in response to a call from the corresponding zone thermostat for conditioned air in a corresponding zone and a coupling mechanism coupling the actuator to the damper blade, the coupling mechanism including a shaft coupled to one of the actuator and damper blade and a cylinder surrounding the shaft coupled to another of the actuator and damper blade, one of the shaft and cylinder including a slot and the other of the shaft and cylinder including a projection into the slot defining limits to the relative movement between the shaft and cylinder, wherein the damper blade is configured to be responsive to any HVAC system static pressure differential in the duct to open and bleed an amount of conditioned air past the damper when the static pressure differential of the system increases above a selected level due to a continuing supply of conditioned air to another of the at least two zones.

2. The control system of claim 1, further comprising a biasing member coupled to the damper blade for biasing said blade toward a closed position.

3. The control system of claim 2, wherein the biasing member comprises a weight coupled to the damper blade.

4. The control system of claim 2, further comprising an adjustment feature to adjust the bias exerted by the biasing element.

5. The control system of claim 1, wherein the slot is dimensioned to provide for about 90° relative movement between the shaft and cylinder.

6. The control system of claim 1, wherein the cylinder is fixed to the actuator for controlled movement by the actuator, and the shaft is fixed to the damper blade for movement therewith.

7. The control system of claim 1, wherein the biasing element comprises a spring coupled between the cylinder and shaft.

* * * * *